United States Patent [19]

Duffield

[11] 4,193,520

[45] Mar. 18, 1980

[54] DEVICE FOR ADDING SOAP TO SHOWER WATER

[76] Inventor: Robert Duffield, R.D. #2, New Alexandria, Pa. 15670

[21] Appl. No.: 829,213

[22] Filed: Aug. 31, 1977

[51] Int. Cl.[2] ..... B67D 5/60

[52] U.S. Cl. ..... 222/133; 222/630; 222/464

[58] Field of Search ..... 222/133, 193, 464; 239/318, 354

[56] References Cited

U.S. PATENT DOCUMENTS

| | | | |
|---|---|---|---|
| 2,612,403 | 9/1952 | Burch | 239/318 |
| 2,744,789 | 5/1956 | Sutton | 222/133 |
| 3,231,200 | 1/1966 | Heald | 239/318 |
| 3,486,695 | 12/1969 | Novak | 239/318 X |
| 3,539,111 | 11/1970 | Johnson | 222/193 |
| 3,764,074 | 1/1972 | James | 239/318 |

*Primary Examiner*—Allen N. Knowles

[57] ABSTRACT

My invention discloses a novel device for adding liquid soap to shower water. Liquid soap is drawn through a tube member by harnessing the negative pressure in a sleeve member, situated within a water source leading to a shower nozzel, relative to the atmosphere. Means for controlling the volume of soap flowing through a tube member adjusts the amount of soap going through the shower head.

2 Claims, 4 Drawing Figures

DEVICE FOR ADDING SOAP TO SHOWER WATER

BACKGROUND OF INVENTION

1. Field of Invention

This invention relates to adding liquid soap to shower water. It more specifically relates to a device for adding soap to shower water that is simply operable and easily controlled by a user.

2. Description of Prior Art

Presently there are numerous devices and methods available for adding soap to the shower water. Numerous hard soap and liquid soap dispensers have been known in the prior art. However, none of the prior art devices is as simply operable as the present invention, as well as providing a means for drawing soap that harnesses the negative pressure, relative to the atmosphere, of a sleeve member which is situated in a water source leading to a shower nozzel as the present invention.

SUMMARY OF INVENTION

A novel device for adding soap to shower water is disclosed. An open ended sleeve member is situated in a water source leading to a shower nozzel. The open end is directed toward the nozzel. A depending tube member is connected on one end to the sleeve member and the other end is situated below the level of liquid soap in a liquid soap container connected to the said depending tube member.

Means for drawing soap through the depending tube member draws the liquid soap into the water source. When water flows through the water source, the pressure in the atmosphere is greater than the pressure within the depending tube member and thus the liquid soap in the liquid soap container is drawn through the depending tube member, into the sleeve member, and then out through the water source to the shower head.

The water source is narrowed at the location of the open end of the sleeve member to increase the speed of water going by. This venturi effect also causes a lower pressure in the sleeve member relative to the atmosphere than without the venturi effect.

The means for drawing includes a first control member fit upon the depending tube member and a second control member rotatably placed within the first control member. An aperture in the second control member is aligned with the depending tube member by a screw and base in the first control member. A rope member attached to the second control member assists a user in either obstructing or not obstructing the flow of liquid soap when water is flowing through the water source. By pulling the rope member, the second control member is rotated along with the aperture when the aperture is 180° with the depending tube member. The liquid soap flows through it. If a 90° angle is created, then there is no liquid soap flow.

Means for controlling the volume of soap flowing through the depending tube member permits the user to adjust the amount of soap flowing through the shower head. The end of the depending tube member situated below the level of liquid soap is threaded. A jacket member having a void screws onto the depending tube member. The size of void and corresponding amount of liquid soap that passes through the void is adjusted by turning the jacket member. The greater the size of the void, the greater amount of soap is allowed to pass through the depending tube member.

It is thus an object of the present invention to add liquid soap to shower water in a simply operable and efficient manner. An important feature of this invention is its simple operation with lack of many mechanically operated parts that could break. My invention harnesses the negative pressure of the sleeve member relative to the atmosphere to draw liquid soap into the shower water.

DESCRIPTION OF PREFERRED EMBODIMENT

Figure 1:
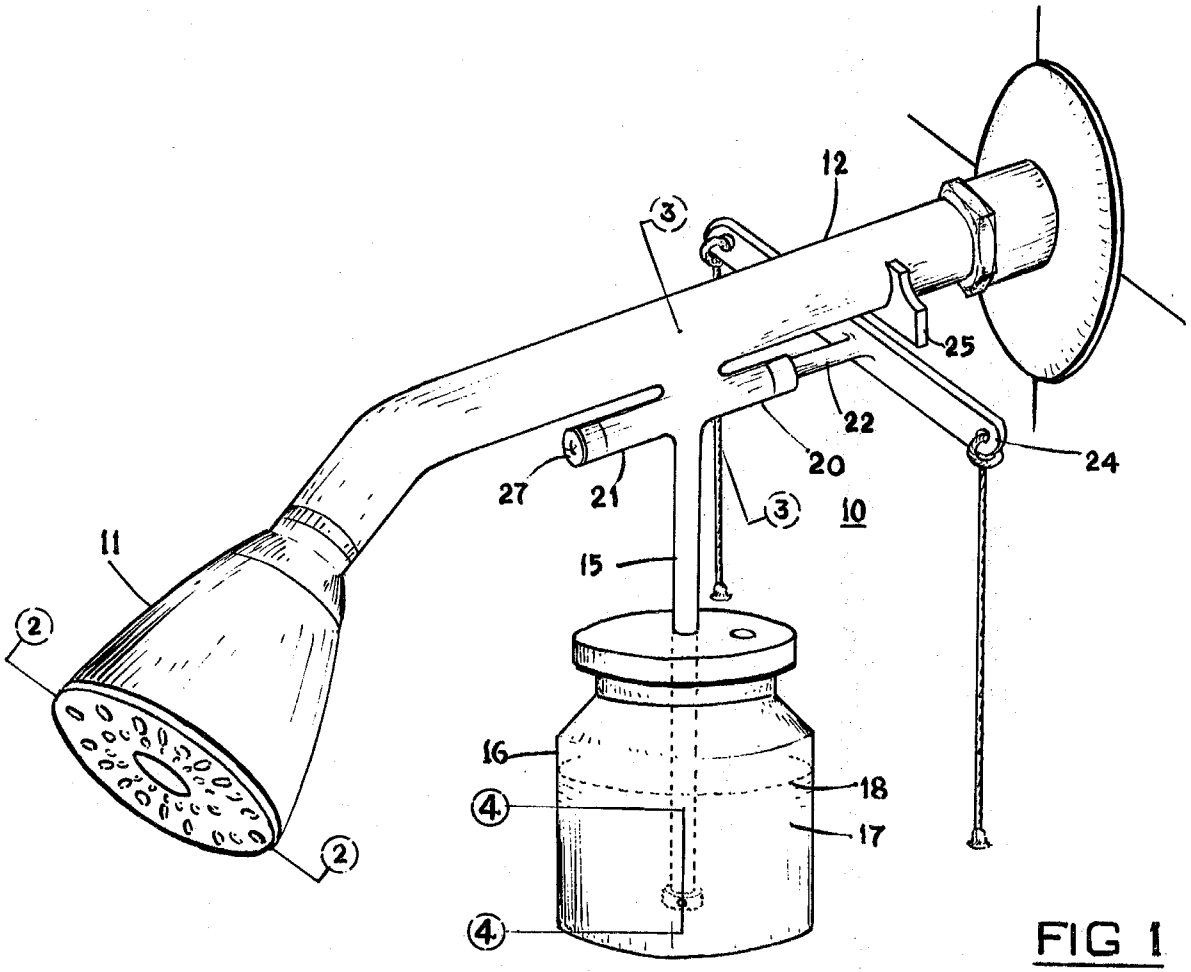
FIG. 1 is a perspective elevational view of an embodiment of the present invention.

Referring to FIG. 1, numeral 10 represents a device for adding soap to shower water. Water source 12 is attached to shower nozzel 11 in a conventional manner to permit water 19 to flow through the shower nozzel.

Figure 2:
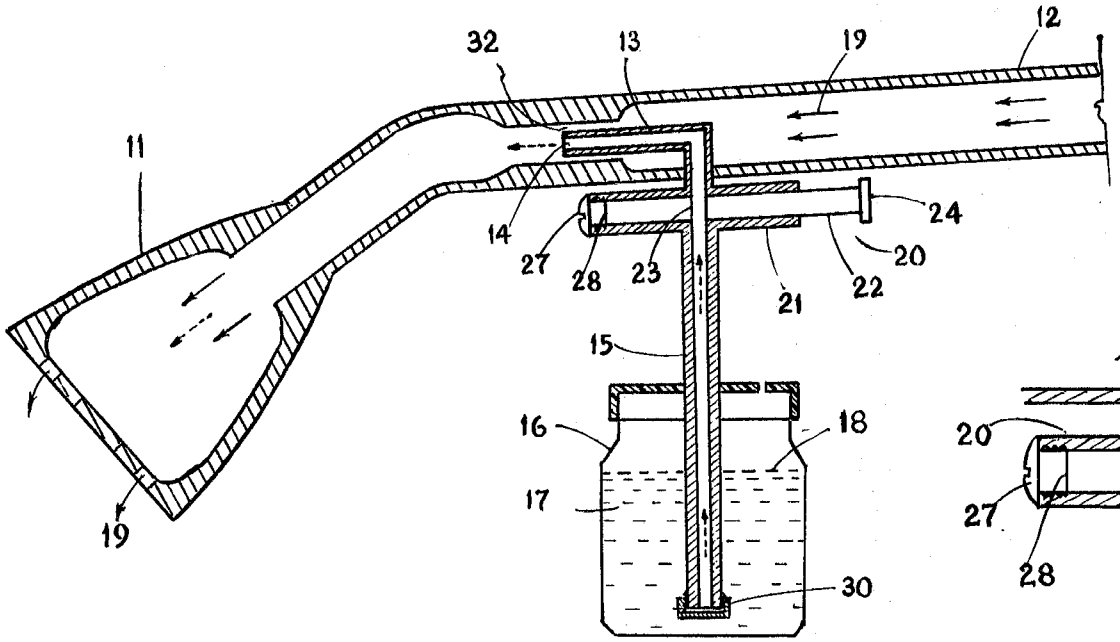
FIG. 2 is a partial sectional view taken along Line 2—2 of FIG. 1 showing the aperture 180° from the depending tube member.

Referring to FIG. 2, sleeve member 13 is situated within water source 12 and has open end 14 directed toward the shower nozzel 11. The water source 12 is narrowed at the location of the open end 14 so that when water 19 is flowing, by a venturi effect, the pressure in the sleeve member is lower relative to the atmosphere than if there was no narrowing. It is important to the operation of my invention to increase the difference between the atmospheric pressure and that in the sleeve member. Depending tube member 15 leads from the sleeve member 13 to liquid soap container 16. Liquid soap container 16 is attached to the depending tube member 15.

Figure 3:
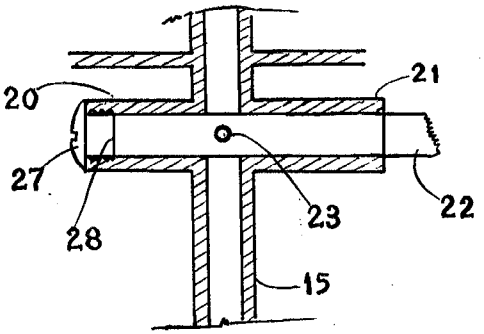
FIG. 3 is another partial sectional view taken along Line 2—2 of FIG. 1, showing the aperture 90° from the depending tube member.

Referring to FIGS. 1, 2 and 3, means for drawing soap through the depending tube member 20 includes first control member 21 connected to the depending tube member 15 and second control member 22 situated within the first control member 21. Said second control member 22 contains an aperture 23. A screw 27 and base 28 secured to the first control member 21 aligns the aperture 23 with the depending tube member 15. The aperture 23 passes completely through second control member 22. When said aperture is lined up horizontally or 180° with tube member 15, then there is unobstructed passage from the sleeve member 13 through the depending tube member 15 as shown in FIG. 2. When said second control member 22 with aperture 23 is rotated 90°, then there is obstruction through the depending tube member 15 as shown in FIG. 3.

Referring again to FIG. 1, rope member 24 is attached to the second control member 22 and dimensioned to rotate said second control member 22 when pulled by a user. Stop member 25 is attached to the water source 12 above the rope member 24. When pulled in one direction, the rope member 24 rotates the second control member 22 until the stop member 25 is hit. It can go no further. At this point, the aperture 23 lines up with the depending tube member 15 and the passage through the depending tube member 15 is unobstructed as shown in FIG. 2.

When the rope member 24 is pulled in the direction away from stop member 25, second control member 22 rotates away and the flow through the tube member 15 becomes obstructed as disclosed in FIG. 3.

In operation, when the flow is unobstructed through tube member 15 and water 19 is flowing through water source 12, the pressure in the sleeve member 13 is less than the atmospheric pressure. This inbalance causes the liquid soap 17 in liquid soap container 16 to pass through the depending tube member 15, through sleeve member 13 and into the water 19 flowing into shower nozzel 11.

Means for controlling volume of liquid soap 26 varies the amount of liquid soap 17 flowing through the depending tube member 15.

Figure 4:
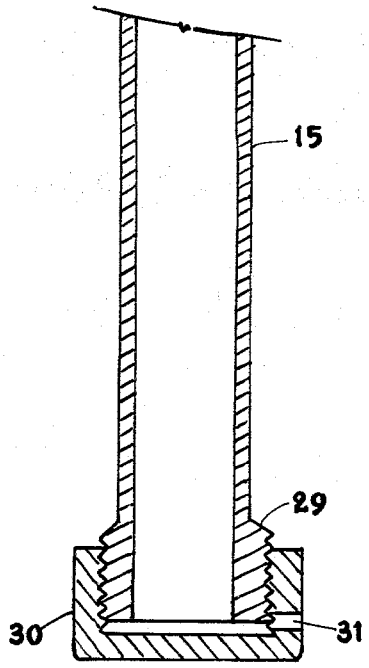
FIG. 4 is a partial sectional view taken along Line 4—4 of FIG. 1.

Referring to FIG. 4, threads 29 are situated on the end of depending tube member 15 situated below the level of liquid soap 18. A jacket member 30 is designed to screw onto threads 29 and contains void 31. The amount of soap flowing through the void 31 is adjustable, depending upon how much the jacket member 30 is turned to obstruct the dimensions of void 31. The greater the size of the void 31, the more soap can flow through the depending tube member 15. The smaller the size of void 31, then less soap can pass through to the depending tube member 15.

I claim:

1. A device for adding soap to shower water comprising:

a. a sleeve member open on one end, situated in a water source leading to a shower nozzle, said open end directed toward the shower nozzle;

b. a depending tube member connected to the sleeve member;

c. a liquid soap container attached to the tube member, one end of the tube member being situated preferrably below the level of liquid soap in the container;

d. means for drawing soap through the depending tube member by harnessing the negative pressure, relative to the atmosphere, of the sleeve member when water is flowing through the water source;

e. said means for drawing soap further comprising:

a first control member situated on the depending tube member;

a second control member situated within the first control member and having an aperture positioned within the depending tube member, said second control member being rotatable within the first control member to permit either the unobstructed or obstructed flow of soap through the depending tube member determined by the position of the aperture when rotated;

a rope member attached to the second control members to assist a user in rotating the control member;

a stop member situated on the water source placed above the rope member in a manner to permit the rotation of the control member so that unobstructed flow exists through the aperture and depending tube member when desired and;

means for controlling the volume of soap flowing through the depending tube member and connected to it.

2. The device of claim 1 wherein one of the depending tube member is dimensioned with threads and wherein the means for controlling comprises:

a jacket member dimensioned to fit along the threads, having a void whose size can be adjusted by turning the jacket member along the threads to permit differing amounts of liquid to flow through the depending tube member.

* * * * *